US006527939B1

(12) United States Patent
Hardee

(10) Patent No.: US 6,527,939 B1
(45) Date of Patent: Mar. 4, 2003

(54) METHOD OF PRODUCING COPPER FOIL WITH AN ANODE HAVING MULTIPLE COATING LAYERS

(75) Inventor: Kenneth L Hardee, Middlefield, OH (US)

(73) Assignee: Eltech Systems Corporation, Chardon, OH (US)

( * ) Notice: Subject to any disclaimer, the term of this patent is extended or adjusted under 35 U.S.C. 154(b) by 197 days.

(21) Appl. No.: 09/599,339

(22) Filed: Jun. 22, 2000

Related U.S. Application Data

(60) Provisional application No. 60/141,299, filed on Jun. 28, 1999.

(51) Int. Cl.[7] ..... C25D 3/38

(52) U.S. Cl. ..... 205/292; 205/296; 205/297; 205/138; 205/77; 204/290.1

(58) Field of Search ..... 205/292, 296, 205/297, 138, 77; 204/290.01

(56) References Cited

U.S. PATENT DOCUMENTS

| | | | | |
|---|---|---|---|---|
| 3,234,110 | A | | 2/1966 | Beer |
| 3,265,526 | A | | 8/1966 | Beer |
| 3,632,498 | A | | 1/1972 | Beer |
| 3,711,385 | A | | 1/1973 | Beer |
| 3,751,296 | A | | 8/1973 | Beer |
| 3,778,307 | A | | 12/1973 | Beer et al. |
| 3,788,968 | A | | 1/1974 | Müller |
| 3,840,443 | A | | 10/1974 | Beer |
| 3,878,083 | A | | 4/1975 | De Nora et al. |
| 3,882,002 | A | | 5/1975 | Cook, Jr. |
| 3,926,751 | A | | 12/1975 | De Nora et al. |
| 3,933,616 | A | | 1/1976 | Beer |
| 3,950,240 | A | | 4/1976 | Cookfair et al. |
| 4,005,003 | A | | 1/1977 | Popplewell et al. |
| 4,039,400 | A | | 8/1977 | Hayfield |
| 4,086,157 | A | | 4/1978 | Koziol et al. |
| 4,272,354 | A | | 6/1981 | de Nora et al. |
| 4,437,948 | A | | 3/1984 | Okinaka et al. |
| 4,469,564 | A | | 9/1984 | Okinaka et al. |
| 4,517,068 | A | | 5/1985 | Hinden et al. |
| 4,528,084 | A | | 7/1985 | Beer et al. |
| 5,167,788 | A | | 12/1992 | Hardee et al. |
| 5,262,040 | A | * | 11/1993 | Hardee et al. ..... 205/292 |
| 5,324,407 | A | | 6/1994 | Ernes et al. |
| 5,407,556 | A | * | 4/1995 | Shimada et al. ..... 205/239 |
| 5,489,368 | A | | 2/1996 | Suitsu et al. |
| 5,783,050 | A | | 7/1998 | Coin et al. |
| 5,908,540 | A | | 6/1999 | Fanti |

FOREIGN PATENT DOCUMENTS

| | | |
|---|---|---|
| EP | 0 090 425 | 10/1983 |
| EP | 0 495 468 A2 | 7/1992 |
| EP | 0 538 955 A1 | 4/1993 |
| EP | 0 598 517 A1 | 5/1994 |
| GB | 1 344 540 | 1/1974 |
| GB | 2 007 712 A | 5/1979 |

OTHER PUBLICATIONS

PCT International Search Report for PCT/US00/17403. Mailed Nov. 15 2000.

* cited by examiner

*Primary Examiner*—Nam Nguyen
*Assistant Examiner*—Wesley A. Nicolas
(74) *Attorney, Agent, or Firm*—Michele M. Tyrpak; Hudak, Shunk & Farine Co. LPA

(57) ABSTRACT

A method of producing copper foil, and more particularly, in an electrochemical cell containing organic substituents, is provided herein. The metal may be deposited on an electrode that comprises an electrode base having at least one undercoating layer of an active coating and at least one topcoating layer of no significant activity. The copper electrodeposition cell can operate without an adverse affect on electrode potential.

16 Claims, No Drawings

METHOD OF PRODUCING COPPER FOIL WITH AN ANODE HAVING MULTIPLE COATING LAYERS

This application claims the benefit of Provisional Application No. 60/141,299, filed Jun. 28, 1999.

BACKGROUND OF THE INVENTION

I. Field of the Invention

The invention is directed to copper foil electrodeposition cells containing organic substituent in the electrolyte. The cells may have an electrode having a first active coating layer and an additional layer that is of no significant activity. The metal can be deposited in cell operation that does not exhibit an adverse effect on electrode potential.

II. Description of the Related Art

It is well known to use coatings for electrodes having a significant quantity of platinum group metal or oxides in them that provide the electrochemical activity of a coating. However, these components are often subject to attack by substances in the electrolyte, especially substituents used in metal electrodeposition electroplating systems. Prior art devices can lose, through interaction with organic substituents in electrolytes, the coating components, as well as loss due to slow attrition of the platinum group metal from standard coatings. The slow attrition loss can be due at least in part to chemical/electrochemical dissolution.

It has, however, been found difficult to provide electrodes of extended service life, especially in electrolyte environments such as used in copper foil electrodeposition and which contain organic substituents detrimental to the stability of the components of an active coating as would contain a platinum group metal or oxide. It would, therefore, be desirable to provide an electrode capable of exhibiting extended lifetimes in such an environment. It would also be desirable to provide an electrode allowing extended electrode lifetimes while having decreased loading of the platinum group metal coating.

SUMMARY OF THE INVENTION

The present invention relates generally to an improved method for copper foil electrodeposition. The method is operational in electrolyte environments containing organic substituent, and overcomes the difficulties associated with electrode operation in such an environment, while providing more advantageous overall results.

The method uses an electrode having a topcoat layer of a valve metal oxide, which can be more stable in the electrolyte, and can minimize significant exposure of any platinum group metal or oxide in a base coating to the electrolyte, thus extending the lifetime of the electrode. This can be achieved without an adverse effect on the cell electrode potential, which was unexpected.

In one aspect, the invention is directed to a method for electrodepositing copper metal foil from an electrolyte solution having organic substituent that is contained in an electrolytic cell comprising at least one oxygen evolving anode, which method provides extended anode activity while maintaining cell electrode potential during said copper electrodeposition, which method comprises:

providing an unseparated electrolytic cell;

establishing in the cell an electrolyte containing organic substituent, and containing the copper metal in solution;

providing an anode in the cell in contact with the electrolyte which anode has multiple coating layers on an electrode base of a valve metal, the electrode base having at least one coating layer of an electrochemically active coating and at least one topcoating layer of a valve metal oxide coating or a tin oxide coating layer, whereby the active coating layer contains a first composition and the topcoating layer contains a second composition;

impressing an electric current on the anode; and conducting the electrodeposition of the copper foil.

Still other benefits and advantages of the invention will become apparent to those skilled in the art upon a reading and understanding of the following detailed specification.

DESCRIPTION OF THE PREFERRED EMBODIMENTS

The electrolytic process of the present invention is particularly useful in the electrodeposition of copper foil, and particularly such deposition from a sulfate electrolyte. The electrode described herein when used in such an electrodeposition process will virtually always find service as an anode. Thus, the word "anode" is often used herein when referring to the electrode, but this is simply for convenience and should not be construed as limiting the invention.

A cell using the present invention can be an electrolytic cell where a gap is maintained between electrodes, and the cell electrolyte is contained within the gap. The electrolyte as a sulfate-containing electrolyte might contain sulfuric acid or copper sulfate. The electrolyte will typically be an aqueous electrolyte, i.e., a water-based electrolyte. The copper might be dissolved in the medium of the electrolyte, such as copper sulfate dissolved in an aqueous medium.

The electrolyte will contain organic substituents. A representative constituent used in the electrodeposition of copper foil is gelatin. Such substituent might also include one or more of thiourea, amines, and animal glue. Some organic additives, as might be present, are disclosed in U.S. Pat. No. 4,469,564 to Okinaka, et al, which patent is incorporated herein by reference. As will be understood, the electrolyte ingredient for plating is copper. The one or more organic substituents are additives to the electrolyte which are generally added to the bath to improve aspects of the plating process such as deposition uniformity.

In addition to providing an unseparated cell and establishing an electrolyte containing organic substituent, plus copper metal in solution, there will be provided in the copper deposition process an anode having multiple coating layers on an electrode base of a valve metal. The layers can be represented by an active layer and at least one topcoating layer that can be a valve metal oxide coating. The active coating layer, or underlayer, contains a first composition and the topcoating layer contains a second composition. These layers will be more particularly described hereinbelow. A coating of the valve metal oxide alone generally only sustain low current densitites in cell operation. It was unexpected that in the copper foil deposition process as described herein, that such operation can sustain an elevated current density for an extended time. As representative of such operation is copper foil deposition at a current density of at least 5 kiloamps per square meter ($kA/m^2$), and often at a density of at least 10 $kA/m^2$, for a cell operating time of over 1,000 hours.

For the electrode having multiple coating layers, the base of a valve metal can be such metal including titanium, tantalum, zirconium, niobium, and tungsten. Of particular interest for its ruggedness, corrosion resistance and availability is titanium. As well as the normally available elemental metals themselves, the suitable metals of the electrode base can include metal alloys and intermetallic mixtures, as well as ceramics and cermets such as contain one or more valve metals. For example, titanium may be alloyed with nickel, cobalt, iron, manganese or copper. More specifically, grade 5 titanium may include up to 6.75 weight percent aluminum and 4.5 weight percent vanadium, grade 6 up to 6 percent aluminum and 3 percent tin, grade 7 up to 0.25 weight percent palladium, grade 10, from 10 to 13 weight percent plus 4.5 to 7.5 weight percent zirconium and so on.

By use of elemental metals, it is most particularly meant the metals in their normally available condition, i.e., having minor amounts of impurities. Thus, for the metal of particular interest, i.e., titanium, various grades of the metal are available including those in which other constituents may be alloys or alloys plus impurities. Grades of titanium have been more specifically set forth in the standard specifications for titanium detailed in ASTM B 265-79.

The electrode base may take various forms, i.e., any of those forms that may be used for the deposition of copper foil, and including mesh, sheet, blades, tubes or wire form. It is contemplated, that for the electrodeposition process the anode base member may be a multi-layer member, e.g., a multi-layer mesh member, such as is disclosed in U.S. Pat. No. 5,783,050, or a multi-layer member having a lead base together with a sheet member. The lead base may comprise lead or alloys of lead, such as lead alloyed with tin, silver, antimony, calcium, strontium, iridium, lithium or tellurium.

Regardless of the metal selected and the form of the anode base member, the surface of such substrate member advantageously is a cleaned surface. This may be obtained by any of the known treatments used to achieve a clean metal surface.

When a cleaned surface, or prepared and cleaned surface has been obtained, and particularly for applying the necessary multiple coating layers which will be on the valve metal base, the base surface may be further treated for enhanced adhesion such as of the electrocatalytic coating layer to the valve metal. This will be achieved by means which include intergranular etching of the substrate metal, sharp grit blasting of the metal surface, or plasma spraying, followed by surface treatment to remove embedded grit.

To prepare a metal such as titanium for etching, it can be most useful to condition the metal, as by annealing, to diffuse impurities to the grain boundaries. Thus, by way of example, proper annealing of grade 1 titanium will enhance the concentration of the iron impurity at grain boundaries. Also for the aspect of etching, it can be desirable to combine a metal surface having a correct grain boundary metallurgy with an advantageous grain size. Again, referring to titanium as exemplary, at least a substantial amount of the grains having grain size number within the range of from about 3 to about 7 is advantageous. Grain size number as referred to herein is in accordance with the designation provided in ASTM E 112-84. A serviceable metal substrate of this condition has been disclosed in U.S. Pat. No. 5,167,788.

Etching will be with a sufficiently active etch solution. Typical etch solutions are acid solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide, or a melt of potassium hydroxide with potassium nitrate. Following etching, the etched metal surface can then be subjected to rinsing and drying steps.

It has also been found that a suitably roughened metal surface can be obtained by special grit blasting with sharp grit followed by removal of surface embedded grit. The grit, which will contain usually angular particles, will cut the metal surface as opposed to peening the surface. Serviceable grit for such purpose can include sand, aluminum oxide, steel and silicon carbide. Upon grit removal, this can provide a suitably roughened, three-dimensional surface. Etching, or other treatment such as water blasting, following grit blasting can remove embedded grit and provide the desirably roughened surface.

In plasma spraying for a suitably roughened metal surface, although the material will be applied in particulate form such as droplets of molten metal, the feed material, e.g., a metal to be applied, may be in different form such as wire form. This is to be understood even though for convenience, application will typically be discussed as material applied in particulate form. In this plasma spraying, such as it would apply to spraying of a metal, the metal is melted and sprayed in a plasma stream generated by heating with an electric arc to high temperatures in inert gas, such as argon or nitrogen, optionally containing a minor amount of hydrogen. It is to be understood by the use herein of the term "plasma spraying" that although plasma spraying is preferred the term is meant to include generally thermal spraying such as magnetohydrodynamic spraying, flame spraying and arc spraying, so that the spraying may simply be referred to as "melt spraying". A substrate of a plasma sprayed surface morphology that can find use herein has been disclosed in U.S. Pat. No. 5,324,407.

It will be understood that the anode base surface may then proceed through various operations, including pretreatment before coating. For example, the surface may be subjected to a hydriding or nitriding treatment. Prior to coating with an electrochemically active coating, it has been proposed to provide an oxide layer by heating the substrate in air or by anodic oxidation of the substrate as described in U.S. Pat. No. 3,234,110. European patent application No. 0,090,425 proposes to platinum electroplate the substrate to which then an oxide of ruthenium, palladium or iridium is chemideposited. Various proposals have also been made in which an outer layer of electrochemically active material is deposited on a sublayer which primarily serves as a protective and conductive intermediate. U.K. Patent 1,344,540 discloses utilizing an electrodeposited layer of cobalt or lead oxide under a ruthenium-titanium oxide or similar active outer layer. Various tin oxide based underlayers are disclosed in U.S. Pat. Nos. 4,272,354, 3,882,002 and 3,950,240. It is also contemplated that the anode base surface may be prepared as with an antipassivation layer.

Following any of the hereinabove discussed considerations for the anode base surface preparation, the electrochemically active coating may then be applied to the anode base member. As representative of the applied electrochemically active coating, or "first composition" as such term is used herein, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385, and 4,528,084. The mixed metal oxide coatings can often include at least one oxide of a valve metal with an oxide of a platinum group metal including platinum, palladium, rhodium, iridium and ruthenium or mixtures of themselves and with other metals.

Further coatings include manganese dioxide, lead dioxide, cobalt oxide, ferric oxide, platinate coatings such as $M_xPt_3O_4$ where M is an alkali metal and x is typically targeted at approximately 0.5, nickel-nickel oxide and nickel plus lanthanide oxides.

The electrocatalytic coating may serviceably be an iridium oxide, or the coating will contain an iridium oxide together with tantalum oxide. Also serviceable are those coatings containing an element of ruthenium oxide in combination with titanium oxide itself or with iridium oxide. These coating compositions are well known in the art and have been disclosed such as in U.S. Pat. Nos. 3,632,498, 3,751,296, 3,778,307, 3,840,443 and 3,933,616, and U.S. Pat. Nos. 3,878,083 and 3,926,751.

Regardless of the coating composition chosen, the preferred coating composition solutions are typically those comprised of $TaCl_5$, $IrCl_3$ and hydrochloric acid, all in aqueous solution. Alcohol based solutions may also be employed. Thus, the tantalum chloride can be dissolved in ethanol or isopropanol and this mixed with the iridium chloride dissolved in either isopropanol or butanol, all combined with small additions of hydrochloric acid.

It is contemplated that any of the multiple coating layers utilized herein will be applied by any of those means which are useful for applying a liquid coating composition to a metal substrate. Such methods include dip spin and dip drain techniques, brush application, roller coating and spray application such as electrostatic spray. Moreover, spray application and combination techniques, e.g., dip drain with spray application can be utilized. With the above-mentioned coating compositions for providing an electrochemically active coating, a roller coating operation can be most serviceable.

Regardless of the method of application of the coating, conventionally, the foregoing coating procedure is repeated to provide a uniform, more elevated coating weight than achieved by just one coating. By uniform, it is meant that the undercoating layer will comprise a layer containing a single composition, e.g., a coating derived from $TaCl_3$ and $IrCl_3$ without other metal or metal oxide constituency. Usually, the number of coats for a representative electrochemically active coating layer of a type as mentioned hereinbefore, such as formed by thermal decomposition, will not exceed about 50 coats, and be preferably, for the amount of electrochemically active coating will not exceed 50 grams per square meter ($g/m^2$), basis the metal content of the coating, e.g., the platinum group metal content of the coating..

Following any of the foregoing coating procedures, upon separation from the liquid coating composition, the coated metal surface may simply dip drain or be subjected to other post coating technique such as forced air drying. Additionally, the first coating layer may be cured following coating. Typical curing conditions for electrocatalytic coatings can include cure temperatures of from about 300° C. up to about 600° C. Curing times may vary from only a few minutes for each coating layer up to an hour or more, e.g., a longer cure time after several coating layers have been applied. However, cure procedures duplicating annealing conditions of elevated temperature plus prolonged exposure to such elevated temperature, are generally avoided for economy of operation. In general, the curing technique employed can be any of those that may be used for curing a coating on a metal substrate. Thus, oven curing, including conveyor ovens may be utilized. Moreover, infrared cure techniques can be useful. Preferably for most economical curing, oven curing is used and the cure temperature used for electrocatalytic coatings will be within the range of from about 450° C. to about 550° C. At such temperatures, curing times of only a few minutes, e.g., from about 2 to 10 minutes, will most always be used for each applied coating layer, although longer times of up to about 60 minutes may be utilized.

Subsequent to the formation of the first coating layer of an electrochemically active coating, there can then be formed the topcoating layer of a "second composition" as such term is used herein. As will be understood by the use of these terms, the second composition layer will differ from the first composition layer. Such second composition layer can be a valve metal oxide, or tin oxide, or mixtures thereof, which tin oxide will be more particularly discussed further on hereinbelow. The topcoating layer will typically be formed from a valve metal alchoxide in an alcohol solvent, with or without the presence of an acid. Such valve metal alchoxides which are contemplated for use in the present invention include methoxides, ethoxides, isopropoxides and butoxides. For example, titanium butyl orthotitanate, titanium ethoxide, titanium propoxide, tantalum ethoxide, or tantalum isopropoxide may be useful. Additionally, salts of the dissolved metals may be utilized, and suitable inorganic substituents can include chlorides, iodides, bromides, sulfates, borates, carbonates, acetates, and citrates, e.g., $TiCl_3$, $TiCl_4$ or $TaCl_5$, in acid solution.

Where titanium oxide will be utilized, it will generally be a readily commercially available oxide such as rutile titanium dioxide. However, it is contemplated that titanium suboxide can be useful, i.e., $TiO_x$ where x is a number between 1.5 and 1.999. It is also contemplated that valve metal oxide may be used with doping agents, such as those which would be incorporated as doping agent precursors into the composition to increase the conductivity of the resulting valve metal oxide layer. For example a niobium salt may be used to provide a niobium doping agent in ion form in the oxide lattice. Other doping agents include ruthenium, iridium, platinum, rhodium and palladium, as well as mixtures of any of the doping agents. Such doping agent for the valve metal oxide may typically be present in an amount from about 0.1% to about 10%, by weight.

As mentioned hereinbefore, it is also contemplated that the topcoating layer may be a tin oxide layer. Where tin oxide is the desired topcoating layer, suitable precursor substituents can include $SnCl_4$, $SnSO_4$, or other inorganic tin salts. The tin oxide may be used with doping agents, such as those which would be incorporated as doping agent precursors into the composition to improve conductivity. For example a niobium salt may be used to provide a niobium doping agent in ion form in the oxide lattice. Other doping agents include ruthenium, iridium, platinum, rhodium and palladium, as well as mixtures of any of the doping agents. Doping agents suitable for a tin oxide barrier layer include antimony, indium, fluorine, chlorine, molybdenum, tungsten or tantalum. Where a doping agent is utilized, in a tin oxide topcoating layer, the doping agent will typically be present in an amount by weight of from about one percent to about twenty percent doping element as an oxide. A preferred range of doping agent is from about 0.1% percent to about 10% percent, by weight.

Following application of the topcoating layer such as of valve metal oxide, which layer may be applied in any manner as hereinbefore described with respect to the first electrochemically active coating layer, the topcoating layer may then proceed through thermal treatment. Where salts of the valve metals are utilized, this thermal treatment may be as by thermal oxidation of the valve metal salts applied to the first electrochemically active coating layer. Thermal treatment will generally be conducted in an oxygen containing environment, preferably air for economy, by heating at a temperature within the range of from greater than about 250° C. up to about 1000° C. For efficient thermal conversion, a preferred heating temperature will be in the range of from about 350° C. to about 700° C. Where the coating is applied as a liquid medium, such thermal treatment will serviceably be observed after each applied coating with such temperature being maintained from about 1 minute to about 60 minutes per coat. However, it is within the concept of the present invention that thermal treatment could occur after a successive number of coating cycles have occurred. Preferably, for efficiency and economy, the temperature will be maintained from about 3 to about 10 minutes per coat. The number of coating cycles can vary but most typically the required amount of valve metal oxide layer, with 1 to 20 coats being usual, although fewer coatings, and even a single coating, is contemplated.

Usually, the number of coats for a representative valve metal oxide coating, such as formed by the thermal decomposition of titanium butyl orthotitanate, will not exceed on the order of about 20, and advantageously for economy will not exceed about 10. However, a plurality of layers may be applied to the electrochemically active coating layer so as to provide the desired loading of valve metal oxide coating.

In a procedure also requiring heat application, and thus not completely unlike thermal oxidation of an applied precursor, it is also contemplated to form a suitable valve metal oxide layer by a chemical vapor deposition method. For this method, there can be utilized a suitable volatile starting material such as one of the organic titanium compounds mentioned hereinabove with the thermal oxidation procedure, e.g., titanium butyl orthotitanate, titanium ethoxide or titanium propoxide. In this chemical vapor deposition method for obtaining a valve metal oxide layer, the volatile starting material can be transported to a suitably prepared roughened and coated surface by an inert carrier gas, including nitrogen, helium, argon, and the like. This compound is transported to a heated substrate which is heated to a temperature sufficient to oxidize the compound to the corresponding oxide. For application of organic titanium compound, such temperature can be within the range from about 250° C. to about 650° C. As has been discussed hereinbefore with thermal oxidation treatment, it is also suitable to utilize in the chemical vapor deposition procedure a doping compound. Such doping compounds have been discussed hereinabove. For example, a volatile niobium compound may be added to the carrier gas transporting the volatile starting material, or such may be applied to the heated substrate by means of a separate carrier gas stream. As with the thermal oxidation process, this chemical vapor deposition procedure is most particularly contemplated for use following preparation of a suitably prepared roughened and coated surface, with the roughness being obtained such as by etching, or by sharp grit blasting, or by melt spraying of metal.

As discussed hereinbefore, the present invention is directed to the operation of electrolytic cells containing organic substituents as additives in the electrolyte within the cell. It is directed to electrolytic cells utilized in copper foil production. It is, however, contemplated that the invention may find general utility in methods of electrowinning, i.e., in operating a cell for the recovery of a metal from a cell electrolyte that contains organic substituent. Metals for recovery include the aforementioned copper, as well as cobalt, zinc, nickel, manganese, silver, lead, gold, platinum, palladium, tin, aluminum, chromium, and iron. Moreover, it is contemplated that the method of the present invention may find use in a metal electrodeposition processes such as plating, e.g., the electroplating of metals such as zinc, cadmium, chromium, nickel, and tin, as well as metal alloys such as nickel-zinc, onto a substrate, wherein the cell has an organic substituent-containing electrolyte. The substrate may be a moving substrate and the electrodeposition in such process can include electrogalvanizing or electrotinning. In such method, it is contemplated that the active coating layer may be topcoated as described hereinabove, but such topcoating can include coating with lanthanide oxides and oxides of spinels or garnets may be used.

It is also contemplated that the electrode utilized in the invention process may have a multi-layered electrode base having the valve metals of the electrode on a base of lead or alloys of lead, such as lead alloyed with tin, silver, antimony, calcium, strontium, indium or lithium. The lead base is usually in a flat sheet form and the sheet is virtually always a solid sheet. However, other forms are contemplated. Thus, for example, the lead base may have a cylindrical form or the like, such as elliptical. Still other forms of the lead base may include a perforate base and form a flow-through electrode. As a sheet form base, the sheet will usually have a thickness within the range of from about ⅛ inch to about 2 inches, but some lead base electrodes can have thickness of up to about 2 feet or more. In general, such electrodes have been disclosed in U.S. patent application Ser. No. 09/273,981, now No. 6,139,705, the disclosure of which is incorporated herein by reference.

The following examples, unless otherwise noted as comparative examples, generally demonstrate the protection of the iridium components of an electrochemically active coating during operation in an electrochemical cell containing an electrolyte comprising $H_2SO_4$ with a gelatin additive:

EXAMPLE 1

A titanium plate sample of unalloyed grade 1 titanium, measuring 3 centimeters (cm) by 2.6 cm by 0.5 cm was provided with a plasma sprayed titanium surface. Prior to plasma spraying of the titanium surface, the surface was degreased and then grit blasted to provide a roughened surface to promote adhesion of the plasma sprayed titanium.

The titanium plate with the plasma sprayed titanium surface was then provided with an electrochemically active oxide coating of tantalum oxide and iridium oxide having a 65:35 weight ratio of Ir:Ta as metal. The sample plate was coated by brush application. The coating weight achieved was about 27 grams per square meter ($g/m^2$ ).

The coated plate was then topcoated with a tantalum oxide coating. The coating composition was an aqueous, acidic solution of tantalum chloride in hydrochloric acid which was diluted 50:50 in isopropanol. The coating was applied in layers, each layer being dried at 100° C. for three minutes, and then baked at 525° C. for ten minutes. A total of ten coating layers were applied by brush application.

The resulting sample was tested as an anode in an electrolyte that was 150 grams per liter of sulfuric acid in deionized water. The test cell was an unseparated cell maintained at 65° C. and operated at a current density of 10 kiloamps per square meter ($kA/m^2$). A constant supply of gelatin additive was fed to the cell at the rate of approximately 45 milligrams per kiloamp per minute (mg/kA/min).

Periodically, the electrolysis was briefly interrupted. The coated titanium plate anode was removed from the electrolyte, rinsed in deionized water, and air dried. The sample was then examined by x-ray flourescence utilizing a Tube Excited Fluorescence Analyzer (TEFA) for loss of iridium from the electrochemically active base coating.

The tantalum oxide topcoated sample exhibited a decrease of less than eight percent (8%) in the iridium x-ray fluorescence peak after 1000 hours of operation.

Comparative Example 1A

Titanium plate samples of unalloyed grade 1 titanium, with no topcoat layer (thus making this a comparative example) were coated with the electrochemically active coating composition of Example 1 in the manner of Example 1 to the coating weight of Example 1. The coated plates without the topcoat were then tested as in Example 1. The samples exhibited a decrease of fifteen to twenty percent (15–20%) in the iridium x-ray fluorescence peak after 1000 hours of operation.

EXAMPLE 2

A titanium plate sample of unalloyed grade 1 titanium, was coated with the electrochemically active coating composition of Example 1 in the manner of Example 1 to the coating weight of Example 1.

The coated plate was then topcoated with a titanium oxide coating. The coating composition was an alcoholic solution of titanium orthobutyltitanate in n-butanol to make a titanium solution of 44 grams per liter (g/l). Concentrated hydrochloric acid was then added in an amount of 40 milliliters per liter (ml/l) of solution. The coating was applied in layers, each layer being dried at 110° C. for three minutes, and then baked at 525° C. for ten minutes. A total of 10 coating layers were applied by brush application.

The resulting sample was tested as an anode in an electrolyte that was 150 grams per liter of sulfuric acid. The test cell was an unseparated cell maintained at 65° C. and operated at a current density of 10 kiloamps per square meter ($kA/m^2$). A constant supply of gelatin additive was fed to the cell at the rate of approximately 45 milligrams per kiloamp per minute (mg/kA/min).

Periodically, the electrolysis was briefly interrupted. The coated titanium plate anode was removed from the electrolyte, rinsed in deionized water, air dried and then cooled to ambient temperature. The sample was then examined by x-ray fluorescence utilizing a Tube Excited Fluorescence Analyzer for loss of iridium from the electrochemically active base coating.

The titanium oxide topcoated sample exhibited a decrease of approximately five percent (5%) in the iridium x-ray flourescence peak after 500 hours of operation.

Comparative Example 2

A titanium plate sample of unalloyed grade 1 titanium, with no topcoat layer (thus making this a comparative example) was coated with the electrochemically active coating composition of Example 1 in the manner of Example 1 to the coating weight of Example 1. The coated plate without the topcoat was then tested as in Example 1. The sample exhibited a decrease of eleven percent (11%) in the iridium x-ray fluorescence peak after 500 hours of operation.

EXAMPLE 3

A titanium plate sample of unalloyed grade 1 titanium, was coated with the electrochemically active coating composition of Example 1 in the manner of Example 1 to the coating weight of Example 1.

The coated plate was then topcoated with a tin oxide/antimony oxide coating. The coating composition was a solution of n-butanol prepared with tin chloride and antimony chloride to which small amounts of hydrochloric acid and sulfuric acid were added. The coating was applied in layers, each layer being dried at 100° C. for three minutes, and then baked at 520° C. for ten minutes. A total of 10 coating layers were applied by brush application.

The resulting sample was tested as an anode in an electrolyte that was 150 grams per liter of sulfuric acid. The test cell was an unseparated cell maintained at 65° C. and operated at a current density of 10 kiloamps per square meter ($kA/m^2$). A constant supply of gelatin was fed to the cell at the rate of approximately 45 milligrams per kiloamp per minute (mg/kA/min).

Periodically, the electrolysis was briefly interrupted. The coated titanium plate anode was removed from the electrolyte, rinsed in deionized water, air dried and then cooled to ambient temperature. The sample was then examined by x-ray fluorescence utilizing a TEFA for loss of iridium from the electrochemically active base coating.

The tin oxide/antimony oxide topcoated sample exhibited a decrease of approximately five percent (5%) in the iridium x-ray fluorescence peak after 540 hours of operation.

EXAMPLE 4

Two separate samples of flattened, standard titanium mesh having a thickness of 0.033 inch were coated with an electrochemically active oxide coating of ruthenium oxide and titanium oxide having a 51:49 weight ratio of Ti:Ru as metal. Each sample mesh was coated by roller application. The coating weight achieved was 20 grams per square meter ($g/m^2$) on each sample.

One sample of coated titanium mesh was then topcoated with a titanium oxide coating. The coating composition was a solution of titanium orthobutyltitanate in n-butanol with a titanium concentration of 44 g/l to which a small amount of hydrochloric acid was added. The coating was applied in layers, each layer being dried at 110° C. for three minutes, and then baked at 525° C. for ten minutes. The second sample of coated titanium mesh was not topcoated.

The resulting samples were tested as anodes in an electrolyte that was 150 grams per liter of sulfuric acid. The test cells were operated until the cell voltage rose rapidly, exceeding twice the initial voltage. Results indicted an extended lifetime of 25% for the topcoated samples as opposed to samples with no topcoat.

A second set of samples prepared as previously described were tested as anodes in an electrolyte that was 300 grams per liter NaCl at a pH of 1.0 and a temperature of 75° C.

The anode potential of each cell was measured versus a standard calomel electrode by applying a constant dc current equivalent to a current density of 1 kiloamp per square meter ($kA/M^2$) with a fixed reference probe spacing of 4 millimeters (mm). Results of testing the anode potential of each cell are presented in Table 1 below.

TABLE 1

| Number of Topcoats | Anode Potential (V) |
|---|---|
| 0 | 1.39 |
| 2 | 1.40 |
| 4 | 1.42 |

TABLE 1-continued

| Number of Topcoats | Anode Potential (V) |
|---|---|
| 6 | 1.42 |
| 8 | 1.40 |

As can be seen from Table 1, the anode potential was not significantly different than the sample with no topcoat.

The invention has been described with reference to the preferred embodiment. Modifications and alterations will occur to others upon a reading and understanding of the specification. It is intended by Applicants to include all such modifications and alterations insofar as they come within the scope of the appended claims or the equivalents thereof.

What is claimed is:

1. A method for electrodepositing copper metal foil from an electrolyte solution containing organic substituent and that is contained in an electrolytic cell, with the cell comprising at least one oxygen evolving anode, which method provides extended anode activity while maintaining cell electrode potential during said copper electrodeposition, which method comprises:

providing an unseparated electrolytic cell;

establishing in said cell an electrolyte containing organic substituent, and containing said copper metal in solution;

providing an anode in said cell in contact with said electrolyte which anode has multiple coating layers on an electrode base of a valve metal, said electrode base having at least one coating layer of an electrochemically active coating and at least one topcoating layer of a valve metal oxide coating or a tin oxide coating layer, whereby said active coating layer contains a first composition and said topcoating layer contains a second composition;

impressing an electric current on said anode; and conducting said electrodeposition of said copper foil.

2. The method of claim 1 wherein there is established a sulfate electrolyte and said sulfate electrolyte contains one or more of sulfuric acid and copper sulfate.

3. The method of claim 2 wherein said sulfate electrolyte contains organic substituent and said substituent is one or more of gelatin, thiourea, amines, and animal glue.

4. The method of claim 1 wherein said electrodeposition of said copper foil is conducted at an elevated current density of at least 5 $kA/m^2$ for an extended time while maintaining cell electrode potential.

5. The method of claim 1 wherein said electrodeposition of said copper foil is conducted at an elevated current density of at least 10 $kA/m^2$ for an extended time of over 1,000 hours.

6. The method of claim 1 wherein there is provided an anode of a valve metal electrode base, said valve metal is selected from the group consisting of titanium, tantalum, zirconium, tungsten, their alloys and intermetallic mixtures thereof, and said valve metal base is in mesh, sheet, blade, tube, or wire form.

7. The method of claim 1 wherein said method comprises providing a coating layer of an electrochemically active coating containing at least one oxide selected from the group consisting of platinum group metal oxides, magnetite, ferrite, cobalt oxide spinel, tin oxide, and antimony oxide, and/or contains a mixed crystal material of at least one oxide of a valve metal and at least one oxide of a platinum group metal, and/or contains one or more of manganese dioxide, lead dioxide, platinate substituent, nickel-nickel oxide or a mixture of nickel plus lanthanum oxides.

8. The method of claim 1, wherein said method further comprises curing said active coating layer by heating at a temperature of from about 300° C. up to about 600° C. for a time of from about 2 minutes up to about 60 minutes per applied layer of coating.

9. The method of claim 1 wherein said topcoating layer of a valve metal oxide is of a valve metal selected form the group consisting of titanium, tantalum, niobium, zirconium, molybdenum, aluminum, hafnium or tungsten.

10. The method of claim 9, wherein said topcoating layer of valve metal oxide is a valve metal oxide prepared from a compound selected from the group consisting of methoxides, ethoxides, propoxides, butoxides, chlorides, iodides, bromides, sulfates, borates, carbonates, acetates, or citrates of the metals and mixtures thereof.

11. The method of claim 1 wherein said topcoating layer containing said second composition is a layer of one or more of titanium oxide, $Ti_{Ox}$ where x is a number between 1.5 and 1.9999, tin oxide and tantalum oxide.

12. The method of claim 11, wherein said tin oxide topcoating layer is doped with one or more of Sb, F, Cl, Mo, W, Nb, Ta, Ru, Ir, Pt, Rh, Pd or In and oxides thereof and said doping agent is present in an amount in the range from about 0.1% to about 20% by weight.

13. The method of claim 1 wherein said method further comprises the step of heating said topcoating layer.

14. The method of claim 13 wherein said heating is by baking a topcoating layer of a valve metal oxide at a temperature of from about 350° C. to about 700° C.

15. The method of claim 1 wherein said method further comprises preparing said electrode base and said electrode base is prepared to receive said multiple coating layers by one or more of etching, grit blasting, thermal spraying or thermally treating.

16. The method of claim 1, wherein said method further comprises providing said electrode base with an anti-passivation first layer, said active coating layer of an electrochemically active coating overcoats said first layer, and said active coating layer is a first composition that contains a platinum group metal, or metal oxide or their mixtures.

* * * * *